US008307833B2

(12) United States Patent
Zeanah

(10) Patent No.: US 8,307,833 B2
(45) Date of Patent: Nov. 13, 2012

(54) ASHTRAY ASSEMBLY

(75) Inventor: Eric Zeanah, Knoxville, TN (US)

(73) Assignee: American Accessories International LLC, Knoxville, TN (US)

( * ) Notice: Subject to any disclaimer, the term of this patent is extended or adjusted under 35 U.S.C. 154(b) by 433 days.

(21) Appl. No.: 12/109,469

(22) Filed: Apr. 25, 2008

(65) Prior Publication Data

US 2008/0264434 A1 Oct. 30, 2008

Related U.S. Application Data

(60) Provisional application No. 60/914,183, filed on Apr. 26, 2007.

(51) Int. Cl.
*A24F 13/18* (2006.01)

(52) U.S. Cl. ..... 131/235.1; 131/256; 131/231; D27/136

(58) Field of Classification Search ..... 131/231, 131/235.1, 256; 13/240.1, 241; D27/102, D27/133–135, 138; 206/246; D30/129; 119/61.5; 220/23.89, 23.87
See application file for complete search history.

(56) References Cited

U.S. PATENT DOCUMENTS

RE15,698 E * 10/1923 Downey ..... 131/235.1
D77,496 S 1/1929 Neahr
D79,300 S 8/1929 Nelson
2,071,394 A * 2/1937 Douglas ..... 229/400
D142,676 S 10/1945 Siegel
D157,884 S 3/1950 McNair
2,504,597 A 4/1950 Sewald, Jr.
2,565,864 A 8/1951 Lindsey
D169,750 S * 6/1953 Hinterschied ..... D27/133
D170,178 S 8/1953 Wood
(Continued)

FOREIGN PATENT DOCUMENTS

EP 00788740 9/2007
(Continued)

OTHER PUBLICATIONS

"Six of the Best: Ashtrays" Internet Webpage; http://www.findaproperty.com/displaystory.aspx?edid=00&salerent=0&storyid=4549; Jul. 23 2005; 4 pages printed from the Internet on Apr. 15, 2011.*

(Continued)

*Primary Examiner* — Richard Crispino
*Assistant Examiner* — Dionne Walls Mayes
(74) *Attorney, Agent, or Firm* — Ryan A. Schneider, Esq.; Troutman Sanders LLP

(57) ABSTRACT

An ashtray assembly for temporarily storing and containing rubbish, such as the ash and butts of cigarettes and cigars. In one aspect, the ashtray assembly can include a base assembly and an insert assembly. The base assembly can comprise a flexible body. The flexible body can include a storage container adapted to receive the rubbish. The flexible body can be made of a flexible material, such as a silicon-containing polymer, such that the flexible body can be manufactured by a molding process. Because the flexible body can be a silicon-container polymer, it may discolor when a lit end of a cigarette makes contact with the base assembly. The insert assembly can comprise an extinguishing member adapted to extinguish cigarettes, cigars, or both. The extinguishing member is preferably made of a generally non-marking and rigid material. The insert assembly can provide structural integrity and can be removably secured within the base assembly.

20 Claims, 5 Drawing Sheets

U.S. PATENT DOCUMENTS

| | | | | | |
|---|---|---|---|---|---|
| 2,779,624 | A | | 1/1957 | Friedman | |
| 2,786,476 | A | * | 3/1957 | Garson | 131/242.6 |
| 3,270,912 | A | * | 9/1966 | Winkelried | 220/495.01 |
| 3,561,453 | A | * | 2/1971 | Kline | 131/241 |
| 3,698,594 | A | * | 10/1972 | Boehlert | 220/495.01 |
| D241,858 | S | * | 10/1976 | Vrignaud | D27/134 |
| 4,027,682 | A | | 6/1977 | Halmaghi | |
| 4,627,448 | A | * | 12/1986 | Kamm et al. | 131/187 |
| D288,010 | S | | 1/1987 | Faulkenberry | |
| D292,028 | S | | 9/1987 | Rhodes | |
| 4,800,845 | A | * | 1/1989 | Budd | 119/61.5 |
| D303,298 | S | | 9/1989 | Grant | |
| D304,508 | S | | 11/1989 | Charet et al. | |
| 4,911,180 | A | * | 3/1990 | Ogasahara | 131/231 |
| 5,038,801 | A | | 8/1991 | Wang | |
| D322,498 | S | | 12/1991 | McClees et al. | |
| D327,756 | S | | 7/1992 | Klein et al. | |
| D333,532 | S | | 2/1993 | Campbell | |
| D403,104 | S | * | 12/1998 | Ries | D27/102 |
| RE36,106 | E | | 2/1999 | Bruno et al. | |
| 6,089,187 | A | * | 7/2000 | Gaspary | 119/61.5 |
| 6,230,653 | B1 | * | 5/2001 | Tobin | 119/72 |
| D446,601 | S | | 8/2001 | Fisher et al. | |
| D454,656 | S | | 3/2002 | Berset et al. | |
| D459,539 | S | | 6/2002 | Foote | |
| 6,516,747 | B1 | * | 2/2003 | Willinger | 119/61.54 |
| 6,523,544 | B1 | | 2/2003 | Ritter et al. | |
| D472,012 | S | | 3/2003 | South | |
| D472,340 | S | | 3/2003 | Whitlock | |
| D484,639 | S | | 12/2003 | Fortner | |
| D490,581 | S | | 5/2004 | Keithly et al. | |
| D493,590 | S | | 7/2004 | Chen | |
| 6,843,255 | B2 | | 1/2005 | Thornell et al. | |
| 6,889,397 | B2 | | 5/2005 | Rosenberg | |
| RE38,746 | E | | 6/2005 | Bruno | |
| 7,204,202 | B2 | * | 4/2007 | Behun et al. | 119/61.5 |
| D555,317 | S | | 11/2007 | Yang et al. | |
| D563,072 | S | | 2/2008 | Zeanah et al. | |
| 2008/0202534 | A1 | * | 8/2008 | Huang | 131/235.1 |

FOREIGN PATENT DOCUMENTS

| | | | |
|---|---|---|---|
| KR | 20-1992-0003761 | | 6/1992 |
| KR | 2006-117710 | * | 11/2006 |

OTHER PUBLICATIONS

Korean International Search Report for PCT Application No. PCT/US2008/061765 dated Aug. 28, 2008.

* cited by examiner

ASHTRAY ASSEMBLY

CROSS-REFERENCE TO RELATED APPLICATIONS

This application claims benefit, under 35 U.S.C. § 119(e), of U.S. Provisional Application Ser. No. 60/914,183, filed 26 Apr. 2007, the entire contents and substance of which is hereby incorporated by reference.

BACKGROUND

Aspects of the present invention relate to ashtray assemblies and, more particularly, to ashtray assemblies having a flexible component.

Ashtrays are well-known in the art. Generally, ashtrays are receptacles used by smokers to deposit trash, such as ash and butts of a cigarette or cigar. Ashtrays are available in a number of sizes, shapes, colors, and materials.

Often, ashtrays are designed with three or more notches along the ashtray's edge. These notches are effective cigarette retaining members, as they correspond to the diameter of a cigarette or cigar and serve as a resting place for same while burning.

Due to the popularity of cigarettes, and the corresponding need for ashtrays, ashtray designs have changed over time. When cigarettes were at their peak, ashtrays were common household items, and decoration was part of their theme. For portability purposes, ashtrays even made their way into automobiles, and portable ashtrays having a cap for transporting rubbish to a larger ashtray or waste site were developed.

Ashtrays are typically manufactured from glass, stoneware, porcelain or metals, such as silver or aluminum; some are, however, made of wood, marble, or clay. The problem with these materials is their rigidity, i.e., they do not have flexible characteristics. Flexible ashtrays are adapted to improve cleaning, manufacturing, shipping, and generally reduce costs.

SUMMARY

What is needed, therefore, is a flexible ashtray that can have rigid characteristics. Further, what is needed is an ashtray comprising a silicon-containing polymer. It is to such an ashtray the present invention is primarily directed.

In one aspect, various embodiments of the present invention provide an ashtray assembly for temporarily storing and containing rubbish, such as the ash, butts, and other waste of cigarettes and cigars. The ashtray assembly can primarily comprise a base assembly and an insert assembly.

The base assembly can comprise a flexible body. The flexible body can have a shape adapted to receive the rubbish, and an insert assembly for providing structural integrity. The flexible body defines a storage container adapted to receive and store rubbish. The storage container includes a bottom, an inner wall, and a crest or flange section, which collectively form and define the container of the flexible body. The bottom, or inner bottom surface, of the storage container can have a generally concave shape and can extend outwardly toward the inner wall. One or both of the bottom and inner wall can define cutout, which can generally take the shape of at least a portion of the insert assembly. The cutout can define a lip or ridge overhanging the cutout, which lip can fold from the inner wall over a portion of the bottom. The inner wall can extend upwardly away from the bottom toward the flange section. The flange section is a peak or rim of the storage container. The flange section can define a plurality of cigarette retaining members for holding one or more cigarettes, often in a lit stage, such that ash from the cigarette falls into and burns within the storage container. The opposing side of the flange section extends downwardly to an outer wall or leg that supports the flexible body. The outer wall can be configures to allow the base assembly to rest upon a generally flat surface.

In an exemplary embodiment, the flexible body is made of a flexible material, such that it can be made by a molding process. For example, the flexible body can be a silicon-based or silicon-containing polymer, such as a silicone-containing polymer, for ease of manufacturing and cleaning. Because the flexible body can be a silicon-containing polymer, it may discolor when a lit end of a cigarette makes contact with the flexible body.

The insert assembly can comprise an extinguishing member. The extinguishing member can be composed of a generally rigid material and can be adapted to extinguish cigarettes, preferably without deformation or discoloration of the extinguishing member material. Further, the extinguishing member can be made of a generally non-marking material such that a lit end of a cigarette will not mark the extinguishing member. The insert assembly can be disposed within the storage container of the base assembly. Preferably, the insert assembly can be removably secured within the base assembly. The lip of the flexible body can provide the means to releasably secure the insert assembly to the base assembly.

These and other objects, features, and advantages of the present invention will become more apparent upon reading the following specification in conjunction with the accompanying drawings.

DETAILED DESCRIPTION

Figure 1:
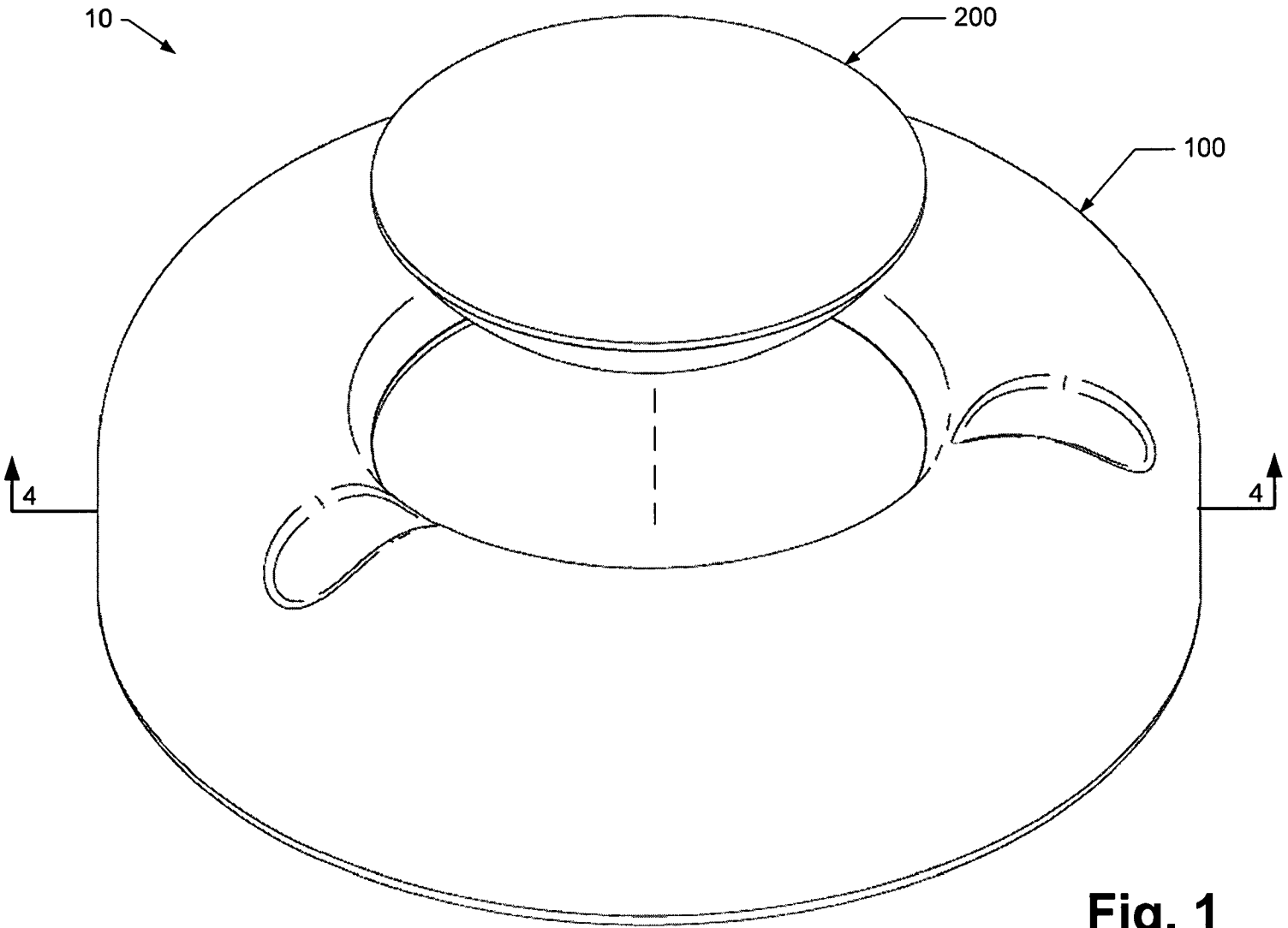
FIG. 1 illustrates an exploded, perspective view of an ashtray assembly having a base assembly and an insert assembly, in accordance with an exemplary embodiment of the present invention.

To facilitate an understanding of the aspects, principles, and features of the present invention, it is explained hereinafter with reference to its implementation in an illustrative embodiment. In particular, aspects of the invention are described in the context of an ashtray assembly with a flexible component. The assembly, however, is not limited to its use as an ashtray. Rather, the assembly can be implemented whenever a flexible container would be beneficial.

The materials described hereinafter as making up the various elements of the ashtray assembly are intended to be illustrative and not restrictive. Many suitable materials that would perform the same or a similar functions as the materials described herein are intended to be embraced within the scope of various aspects of the ashtray assembly. Such other materials not described herein can include, but are not limited to, for example, materials that are developed after the development of the assembly.

Referring now to the figures, wherein like reference numerals represent like parts throughout the views, the present invention will be described in detail.

An ashtray assembly 10 is designed for disposal, storage, and containment of litter, ashes, butts, and unused portions of cigarettes, cigars, and/or other waste (collectively referred to herein as "rubbish"). The ashtray assembly 10 is designed for stability and, therefore, enables easy and rather convenient disposal of rubbish. Although the ashtray assembly 10 can be of various sizes and shapes, the ashtray assembly 10 is preferably large enough to store one or more cigarette or cigar butts or other rubbish.

FIG. 1 illustrates an exploded view of the ashtray assembly 10. The ashtray assembly 10 can comprise a base assembly 100 and an insert assembly 200. At least a portion of the base assembly 100 can have a shape adapted to receive rubbish. For example, the base assembly 100 defines a container. The insert assembly 200 can provide structural integrity to the base assembly 100. By design, the ashtray assembly 10 is adapted to rest on a generally flat surface.

Figure 2:
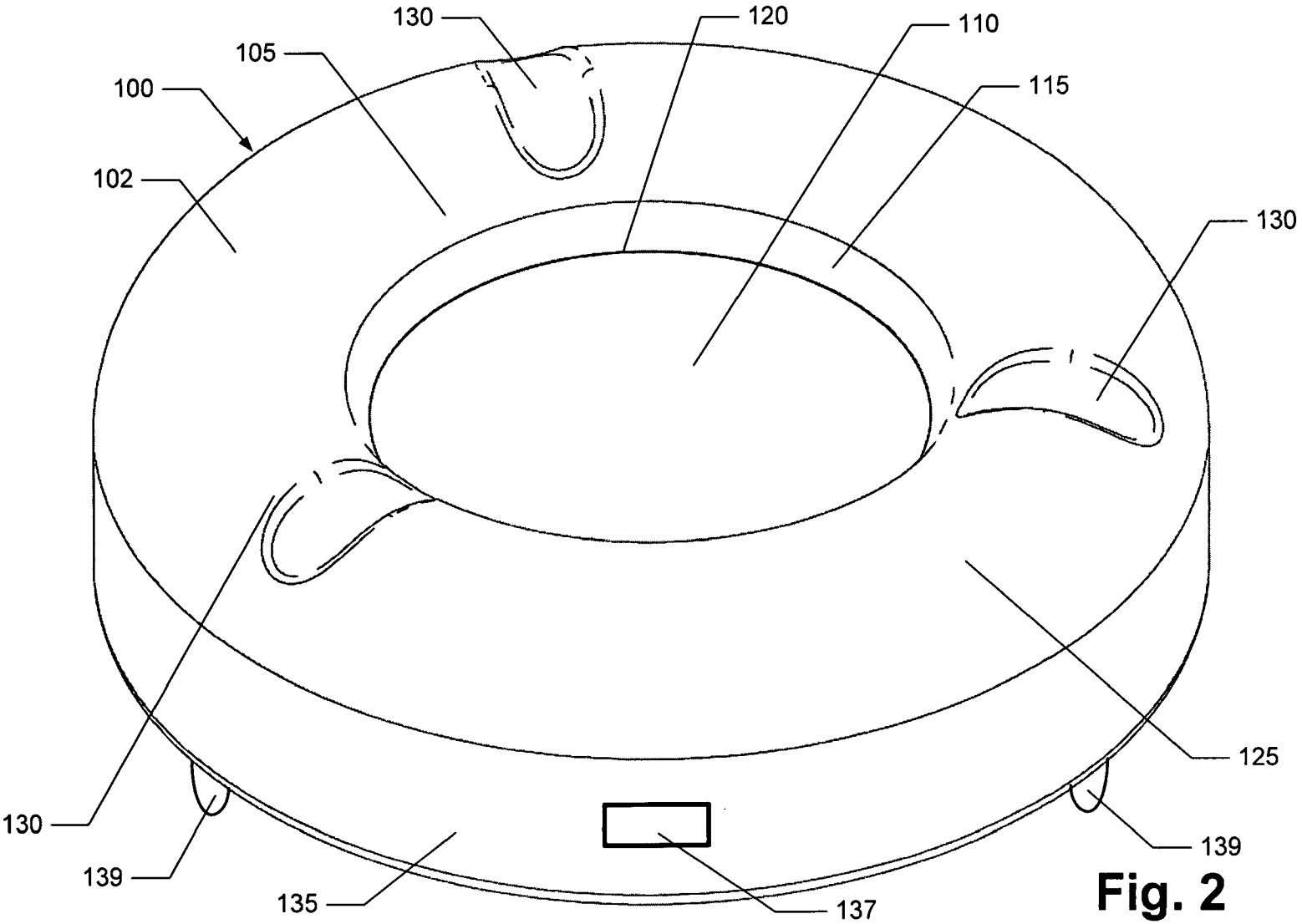
FIG. 2 illustrates a perspective view of the base assembly of the ashtray assembly of FIG. 1, in accordance with an exemplary embodiment of the present invention.

FIG. 2 is a perspective view of the base assembly 100 of the ashtray assembly 10. The base assembly can comprise a flexible portion, such as a flexible body 102. The flexible body 102 can include a storage container 105 for receiving and storing rubbish. Accordingly, rubbish can be received by the storage container 105 or removed from the storage container 105, as needed or desired.

One skilled in the art would appreciate that the storage container 105 can comprise cap, lid, or top that can have open and closed positions. If the storage container 105 includes a cap, the cap can restrict the amount of rubbish that can enter or exit the container when the cap is closed. Further, one skilled in the art would also appreciate that such a cap could be either fittable atop the storage container or pivotally connected thereto.

As shown in FIG. 2, the storage container 105 includes a bottom 110, an inner wall 115, and a flange section 125, which collectively form the container 105. The bottom 110, or inner bottom surface, of the storage container 105 can extend outwardly toward the inner wall 115. The bottom 110 can have a generally concave shape, but other receiving shapes can be implemented. The inner wall 115 can extend upwardly away from the bottom 110 toward the flange section 125. A lip 120 can be positioned between the bottom 110 and the inner wall 115, and is described in detail below.

The flange section 125 is a peak, edge, or rim of the storage container 105. The flange section 125 can define a plurality of cigarette retaining members 130 for holding one or more cigarettes, often lit, such that ash from the cigarettes falls into and remains within the storage container 105. Opposite the inner wall 115, the flange section 125 extends downwardly forming an outer wall 135, or leg, that supports the base assembly 100. The outer wall 135 provides support to allow the base assembly 100 to rest upon a generally flat surface. An outer bottom surface 140 (see FIG. 4) is located opposite the inner bottom surface 110 on the underside of the flexible body 102. The outer wall 135 is preferably longer in length than the depth of the terminus of the bottom 110, such that the outer wall 135, rather than the bottom 110, rests on the surface. That is, the outer wall 135 extends below the outer bottom surface 140 when the flexible body 102 is in an upright position.

As one skilled in the art would appreciate, the storage container 105 can have many shapes and sizes. It is preferred that the storage container 105 includes at least the bottom 110, the inner wall 115, and the flange section 125.

The flexible body 102 can be composed of a flexible material, such that it can be made by a molding process. In an exemplary embodiment, the flexible body 102 can be a silicon-containing polymer for ease of manufacturing and cleaning. Because the flexible body 102 can be a silicon-containing polymer, it may discolor when a lit end of a cigarette makes contact with the base assembly 100. Often, silicon-containing polymers will discolor when a flame or, for example, an end of a lit cigarette, touches it. Thus, different colors can be implemented to help reduce the severity of the discoloration of the polymer.

The flexible body 102 can also be made of some other polymer. For example not limitation, the flexible body 102 can be made of a polymer material, such as DERLIN®, which provides a durable and smooth finish. The flexible body 102 can also be constructed from other polymer materials, such as polyolefins, which include without limitation ultra-high molecular weight (UHMW) polyethylenes, low, medium, and high density polyethylenes, polyurethanes, polyamides, and copolymers, and combinations thereof.

The base assembly 100 can take many shapes, and include many unique aesthetic qualities. For example not limitation, the shape of base assembly 100 can be rectangular, circular, triangular, or oval, and can include a logo or design 137 thereon. If it is desired that the ashtray assembly 10 display a logo 137, the mold to make the flexible body 102 can be adapted accordingly. Additionally, the base assembly can have one or more feet 139 attached to, protruding from, or in communication with a lower portion of the base assembly 100. The feet 139 can support the ashtray assembly 10 and, if varying heights of feet 139 are provided on a single ashtray assembly 10 or if the feet 139 are provided only on a portion of the base assembly 100, the feet 139 can level the ashtray assembly 10 when the ashtray assembly 10 is set on an angled or uneven surface.

In an exemplary embodiment, the flexible body 102 is adapted to be generally shatter-proof. If the flexible body 102 is dropped, for example from a height of ten feet, it will not break, deform, or shatter. Conventional ashtrays are manufactured from glass, stoneware, porcelain, metals, wood, marble, or clay. Many of these materials break or permanently deform if dropped. The flexibility and durability of the flexibly body 102 can enable the ashtray assembly 10 to fall from given heights without breaking, deforming, or shattering.

Figure 3:
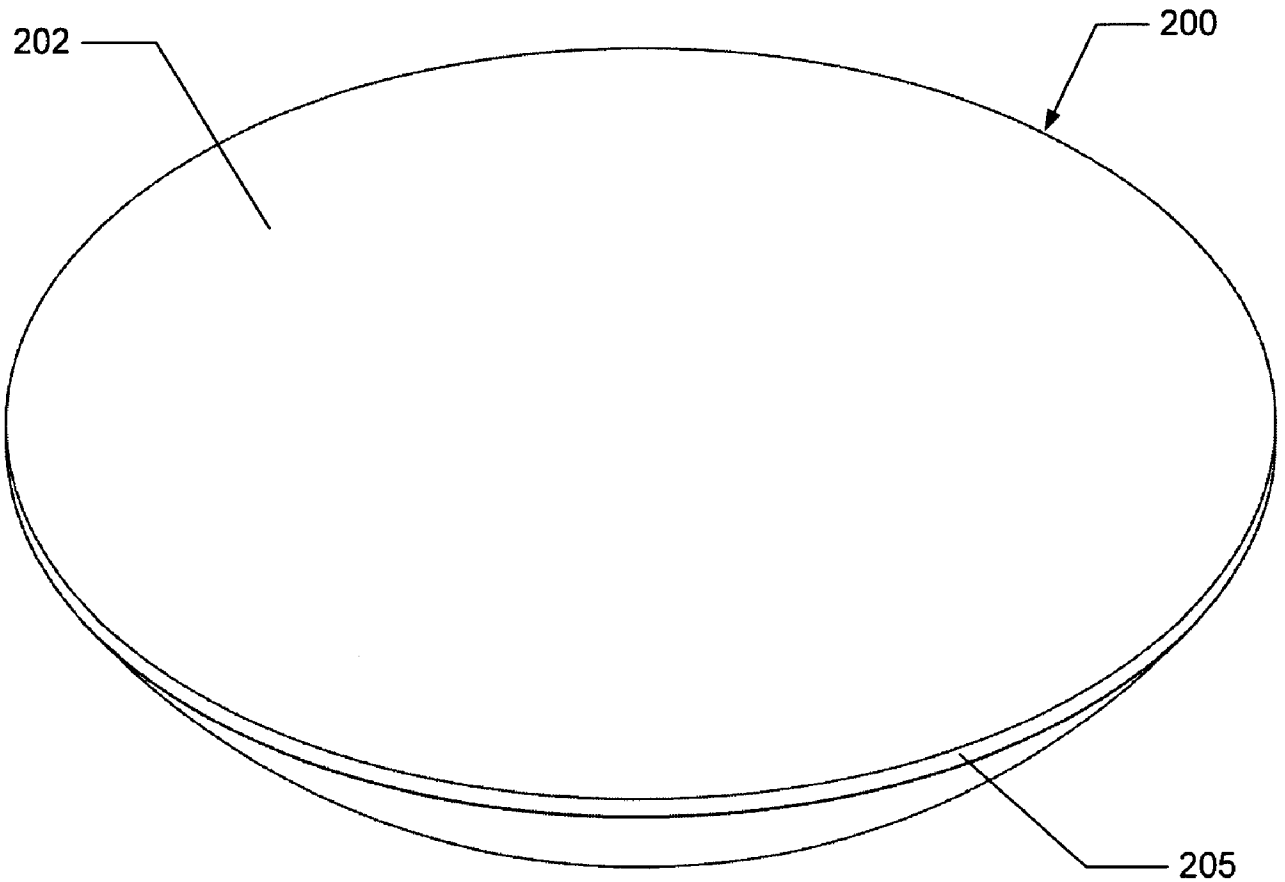
FIG. 3 illustrates a perspective view of the insert assembly of the ashtray assembly of FIG. 1, in accordance with an exemplary embodiment of the present invention.

Referring now to FIG. 3, the insert assembly 200 of the ashtray assembly 10 is illustrated in a perspective view. The insert assembly 200 can comprise an extinguishing member 202 adapted to extinguish cigarettes are cigars.

The extinguishing member 202 is preferably made of a generally rigid material for supporting the base assembly 100 or for easily extinguishing a cigarette. For instance, the extinguishing member 202 can be composed of a metal, such as aluminum, stainless steel, galvanized steel, or a combination thereof. Preferably, the extinguishing member 202 is manufactured from a material that is lightweight and can withstand a flame, preferably without discoloring. Further, the extinguishing member 202 can be made of a generally non-marking material.

It is preferred that the extinguishing member 202 is sufficiently smooth enough for easy extinguishing of a lit end of a cigarette. The extinguishing member 202 can be a hardened piece or, alternatively, can be a sheet with flexibility along its body.

The insert assembly 200 can be disposed within the storage container 105 of the base assembly 100. Preferably, the insert assembly 200 can be removably or releasably secured within the base assembly 100 by the lip 120.

In an exemplary embodiment, as illustrated in FIG. 3, the insert assembly 200 can have a generally concave shape. It is preferable that the shape of the insert assembly 200 mirrors, or is at least complimentary to, the shape of the storage container 105 of the base assembly 100. Such a shape can provide a preferred method of assembling the insert assembly 200 within the base assembly 100.

Figures 4A, 4B:
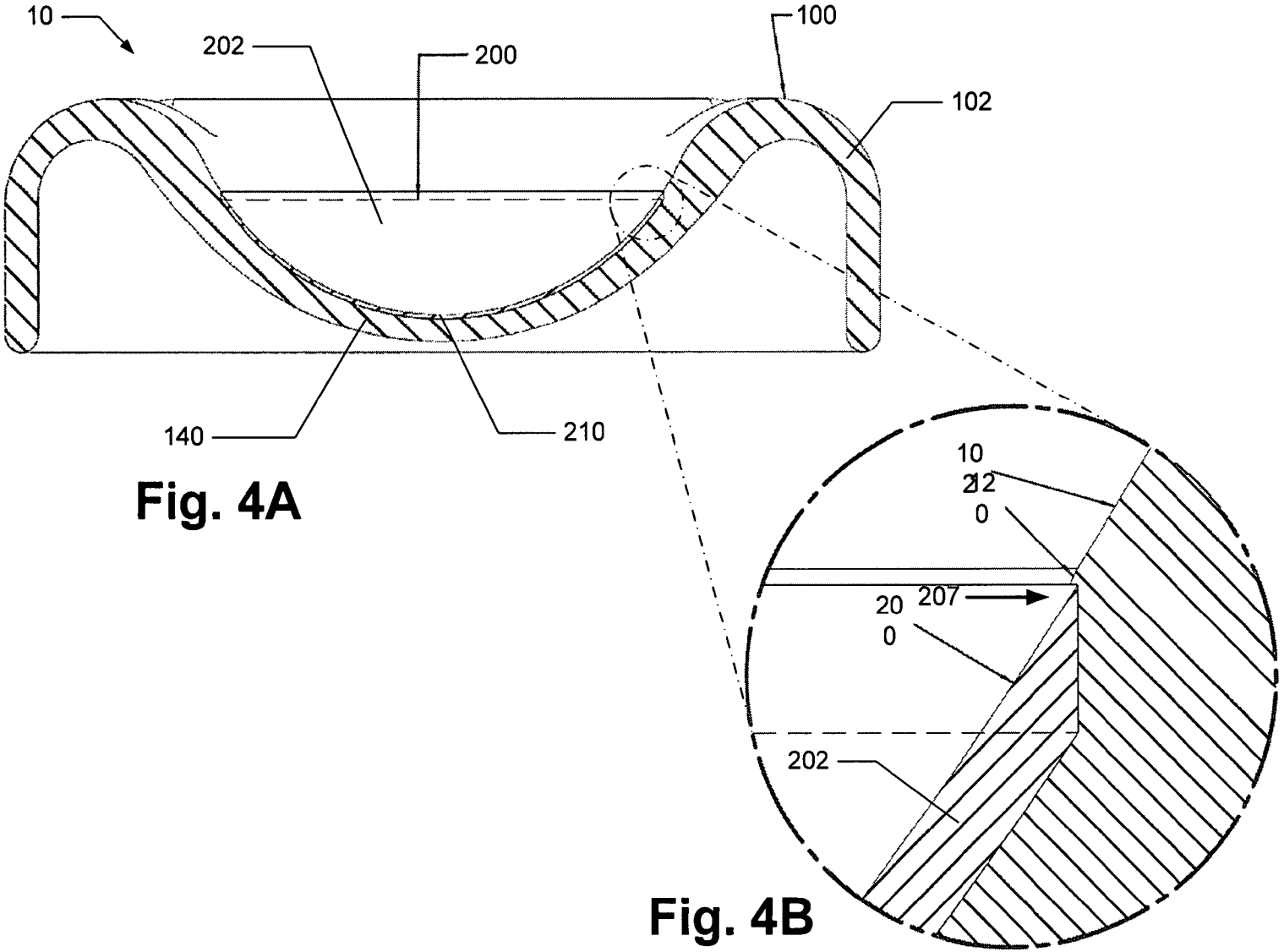
FIG. 4A illustrates a collapsed, cross-sectional view across line 4-4 of FIG. 1 of the insert assembly disposed within the base assembly.
FIG. 4B illustrates a close-up of a portion of the collapsed, cross-sectional view of FIG. 4A.

FIGS. 4A-4B illustrate collapsed, cross-sectional views across line 4-4 of FIG. 1 of the assembled ashtray assembly 10, showing the insert assembly 200 disposed within the base assembly 100. The insert assembly 200 is cooperatively shaped to fit along the bottom 110 of the storage container 105, and the edge 205 of the insert assembly 200 can be nestled beneath the lip 120 of the storage container. The inner wall 115, the bottom 110, or both can define a cutout 207, which cutout can define the lip 120. The lip 120 can be located in the inner wall 115 or between the bottom 110 and the inner wall 115, such that the lip 120 extends over the cutout 207 and the bottom 110. The cutout 207 can be of the generally the same shape of at least a portion of the insert assembly 200.

The insert assembly 200 can be positioned within the storage container 105, such that the edge 205 of the extinguishing member 202 rests beneath the lip 120 of the storage container 105. In this arrangement, the insert assembly 200 can have restricted movement. The entire edge 205 of the extinguishing member 202 is sealed within the base assembly 100, or more specifically within the storage container 105. A portion of the bottom 210 of the insert assembly 200 or the inner bottom surface 110 of the flexible body 102 can be lined with an adhesive for improved securing of the insert assembly 200 within the base assembly 100. Alternately, the insert assembly 200 can be removably secured within the base assembly 100, such that there is no adhesive between the insert assembly 200 and the base assembly 100. Such securing can be provided by the lip 120.

Figure 5:
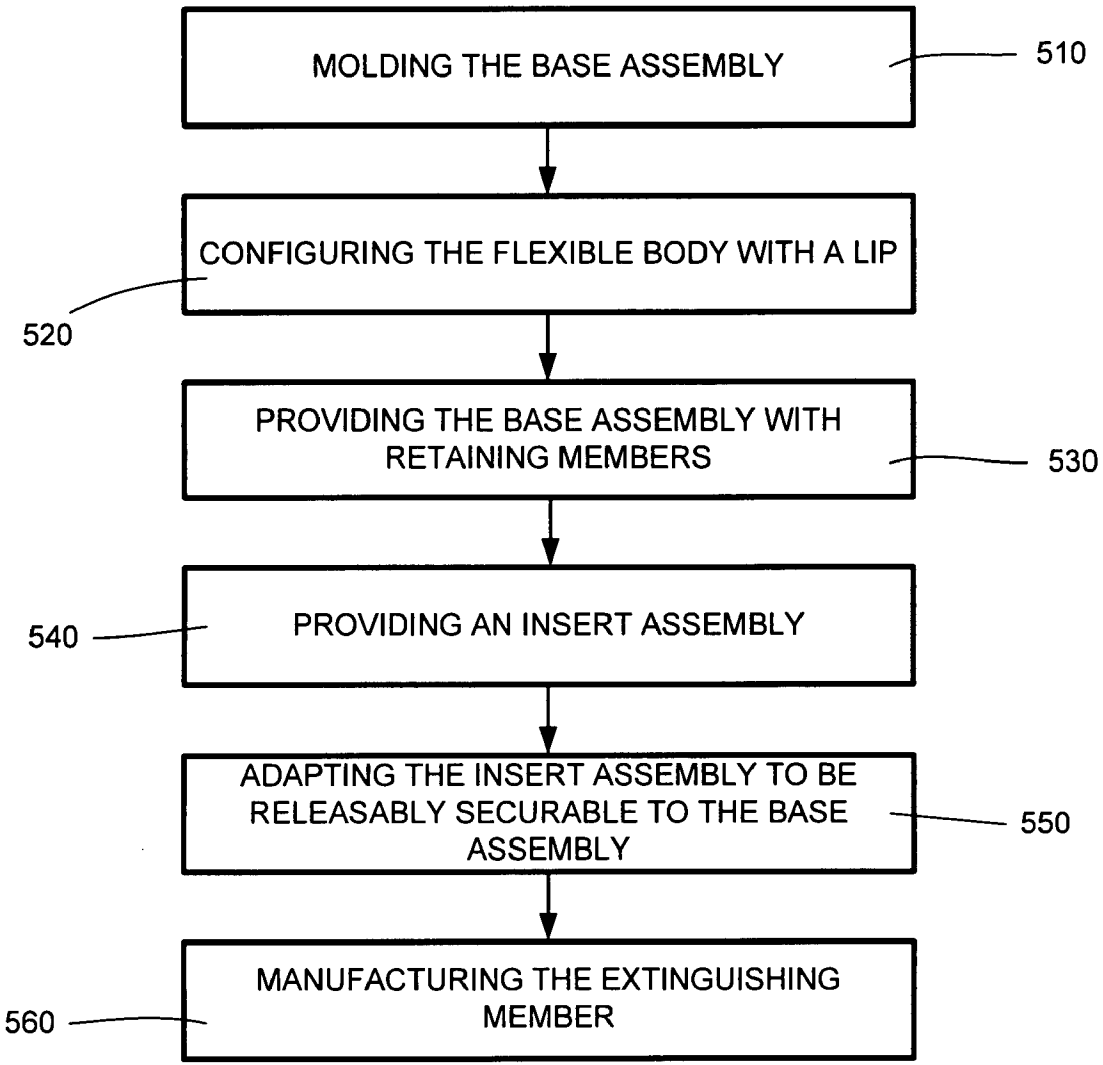
FIG. 5 illustrates a flow chart of a manufacturing process of the ashtray assembly, in accordance with an exemplary embodiment of the present invention.

FIG. 5 illustrates a flow chart of a manufacturing process of the ashtray assembly 10, in accordance with an exemplary embodiment of the present invention. Each box in FIG. 5 represents a sub-process of the manufacturing process. Those of skill in the art would appreciate that the sub-processes illustrated in FIG. 5 need not be undertaken in the order illustrated, and one or more of the sub-processes can be segments of other indicated processes. Further, not all of the processes illustrated need be undertaken in every embodiment of the present invention.

In an exemplary embodiment, the manufacturing process can comprise molding the base assembly, or molding the portion of the base assembly comprising the flexible body at 510. At 520, the flexible body can be configured with the lip to secure the insert assembly, which can occur during the molding process (510). The base assembly or a portion of the base assembly, such as the flexible body, can be provided with the retaining members for retaining cigarettes over the container at 530. The manufacturing process can further include providing an insert assembly at 540, and at 550, adapting the insert assembly to be releasably securable to the base. At 560, the extinguishing member can be manufactured, preferably from a lightweight, flame-resistant metal.

While the ashtray assembly has been disclosed in its exemplary forms, it would be apparent to those skilled in the art that many modifications, additions, and deletions can be made therein without departing from the spirit and scope of the invention and its equivalents, as set forth in the following claims.

What is claimed is:

1. An ashtray assembly comprising:

a base assembly comprising a flexible body for receiving rubbish, the flexible body comprising:

a closed inner bottom surface for supporting the rubbish having a generally concave shape;

an inner wall extending upwardly from the inner bottom surface, the inner wall defining a cutout and a lip overhanging the cutout at a midpoint of the inner wall;

a crest section defining a peak of the inner wall;

one or more cigarette retaining members defined within the crest section;

an outer wall extending downwardly from the crest section;

an outer bottom surface opposing the inner bottom surface on an underside of the flexible body, the outer bottom surface extending no farther downward than the outer wall; and a rigid insert assembly comprising an extinguishing member, the insert assembly fittable into the inner bottom surface, wherein the insert assembly is recessed within the inner wall and extends no further than the lip.

2. The ashtray assembly of claim 1, wherein the cutout secures the perimeter of the insert assembly within the flexible body.

3. The ashtray assembly of claim 1, the insert assembly having a shape complimentary to the shape of the inner bottom surface of the base assembly.

4. The ashtray assembly of claim 1, wherein the insert assembly provides structural integrity to the base assembly.

5. The ashtray assembly of claim 1, the inner bottom surface and the inner wall collectively defining a container of the flexible body.

6. The ashtray assembly of claim 1, wherein the flexible body is made of one or more silicon-containing polymers.

7. The ashtray assembly of claim 1, the insert assembly adapted to be secured to the base assembly by an adhesive.

8. The ashtray assembly of claim 1, the extinguishing member composed of a rigid, flame resistant material.

9. The ashtray assembly of claim 1, wherein the insert assembly is substantially concave shaped.

10. The ashtray assembly of claim 1, wherein the insert assembly is completely fittable within the inner bottom surface.

11. The ashtray assembly of claim 10, wherein the extinguishing member comprises at least one metal.

12. The ashtray assembly of claim 1, wherein the outer wall extends below the outer bottom surface when the ashtray assembly is in an upright position.

13. An ashtray assembly comprising a base assembly, the base assembly comprising a flexible body, the flexible body comprising:

a closed bottom having a generally concave shape;

an inner wall extending generally upwardly from the bottom, the bottom and inner wall defining a storage container for receiving rubbish, the inner wall further defining a cutout and a lip overhanging the cutout at a midpoint of the inner wall;

a flange section comprising a rim, the rim comprising one or more cigarette retaining members;

an outer wall extending downwardly from the flange section, the outer wall adapted to support the flexible body, wherein the outer wall opposes an underside of the bottom; and a rigid insert assembly fittable into the bottom, and wherein the insert assembly is recessed within the bottom and extends no further than the lip.

14. The ashtray assembly of claim 13, wherein the flexible body is made of one or more silicon-containing polymers.

15. The ashtray assembly of claim 13, the underside of the bottom disposed no lower than a lowest portion of the outer wall.

16. The ashtray assembly of claim 13, the inner wall of the flexible body adapted to releasably secure the insert assembly to the base assembly.

17. The ashtray assembly of claim 13, the inner wall defining a cutout having a perimeter generally a same shape as a perimeter the insert assembly.

18. The ashtray assembly of claim 13, further comprising one or more feet in communication with the flexible body, the feet adapted to support the flexible body.

19. A method for manufacturing an ashtray assembly, the method comprising:

molding a base assembly, the base assembly comprising a flexible body to store rubbish, the flexible body comprising:

a closed bottom having a generally concave shape an inner wall extending generally upwardly from the bottom, the inner wall defining a cutout and a lip overhanging the cutout at a midpoint of the inner wall, a flange section comprising a rim, and an outer wall extending downwardly from the flange section, wherein the outer wall opposes an underside of the bottom;

providing the base assembly with one or more cigarette retaining members; and providing a rigid insert assembly comprising an extinguishing member, the insert assembly fittable into the bottom, and wherein the insert assembly is recessed within the bottom and extends no further than the lip.

20. The method of claim 19, wherein the lip releasably secures the insert assembly to the base assembly.

* * * * *